US009802740B2

(12) United States Patent
Schunk

(10) Patent No.: US 9,802,740 B2
(45) Date of Patent: Oct. 31, 2017

(54) STORAGE TANK HATCH LINER

(71) Applicant: Jeff Ray Schunk, Mason, MI (US)

(72) Inventor: Jeff Ray Schunk, Mason, MI (US)

( * ) Notice: Subject to any disclaimer, the term of this patent is extended or adjusted under 35 U.S.C. 154(b) by 0 days.

(21) Appl. No.: 14/961,993

(22) Filed: Dec. 8, 2015

(65) Prior Publication Data

US 2017/0158391 A1 Jun. 8, 2017

(51) Int. Cl.
*B65D 39/00* (2006.01)
*B65D 53/02* (2006.01)
*B65D 90/10* (2006.01)

(52) U.S. Cl.
CPC ..... *B65D 53/02* (2013.01); *B65D 90/10* (2013.01)

(58) Field of Classification Search
CPC ..... B65D 2543/00546; B65D 43/0214
USPC ..... 220/647, 645, 792, 795; 227/647, 645; 215/270
See application file for complete search history.

(56) References Cited

U.S. PATENT DOCUMENTS 802,001 A * 10/1905 Lorenz ..... B65D 39/04 215/270
1,026,542 A * 5/1912 Womelsdorf ..... F16J 15/0887 277/647
1,300,224 A * 4/1919 Rood ..... B65D 39/04 215/270
3,199,879 A * 8/1965 Fleming ..... F16L 23/125 277/608
4,076,142 A * 2/1978 Naz ..... B65D 39/0017 215/260
4,116,352 A * 9/1978 Davis ..... B65D 51/145 215/270
4,278,487 A * 7/1981 Hormanns ..... B60J 10/17 156/305
4,440,407 A * 4/1984 Gagas ..... E02D 29/14 277/644
4,928,615 A 5/1990 Williams
5,715,965 A 2/1998 Goulding
6,021,912 A * 2/2000 Hertrampf ..... B65D 41/0421 215/260
6,024,246 A * 2/2000 Huang ..... B65D 43/0212 215/279
6,050,199 A 4/2000 Anderson et al.
6,527,476 B1 3/2003 Pettesch
6,779,672 B2 * 8/2004 Kano ..... B65D 41/0421 215/252
7,032,905 B2 * 4/2006 Mullally ..... F16J 15/024 277/626

(Continued)

*Primary Examiner* — King M Chu
(74) *Attorney, Agent, or Firm* — Young Basile Hanlon & MacFarlane, P.C.

(57) ABSTRACT

A replaceable liner is for use with a storage tank hatch having a rim adapted to engage with a gasket within a cover and a neck extending vertically downward from the rim to define an aperture that provides access to an inside of the storage tank. The replaceable liner has a body having a rim-facing surface having a vertical cross sectional shape that conforms to a vertical cross sectional shape of the rim and a horizontal cross sectional shape that conforms to a perimeter of the rim, and a gasket facing surface opposite the rim facing surface. Sealant is provided along the rim facing surface of the body, the rim facing surface of the body adapted to engage the rim in a vapor-tight seal, and the gasket facing surface adapted to engage the gasket in a vapor-tight seal.

11 Claims, 4 Drawing Sheets

(56) References Cited

U.S. PATENT DOCUMENTS

| | | | | |
|---|---|---|---|---|
| 7,866,040 | B2 * | 1/2011 | Swensen | F16J 15/061 277/647 |
| 8,251,373 | B2 * | 8/2012 | Lev | F16J 15/3236 277/442 |
| 8,268,032 | B2 * | 9/2012 | Eyers | F02C 7/055 277/627 |
| 8,608,021 | B2 | 12/2013 | Poulter | |
| 2005/0184264 | A1 * | 8/2005 | Tesluk | A61M 39/105 251/148 |
| 2013/0264341 | A1 | 10/2013 | Cockerham et al. | |

* cited by examiner

STORAGE TANK HATCH LINER

TECHNICAL FIELD

The present disclosure relates to fluid storage tank hatches, and more particularly to accessories for such hatches.

BACKGROUND

Storage tanks used to store industrial oils and other fluids (e.g., liquids and gasses) must be properly sealed to prevent leakage of vapors contained within the tanks. The fluids can contain volatile compounds such as hydro carbons or other contaminants which, if released, can harm the environment or persons handling the tanks. Companies can face government penalties if their storage tanks are not sufficiently vapor tight. For example, the EPA conducts leakage tests on industrial storage tanks using sophisticated infrared cameras and has the authority to levy steep penalties—even for minimal leakage that would be imperceptible without the use of such equipment.

Storage tanks are usually accessed by way of a hatch commonly known as a "thief hatch." The base of the hatch is affixed to the body of the storage tank and includes an opening providing access to the contents of the tank. The hatch is closed using a cover, which typically produces a seal by means of a rubber gasket that compresses against the base. However, hatches typically used with fluid storage tanks are difficult to keep adequately sealed and are a common source of tank leaks. The reason is that the point of contact between the gasket and the base is at a rim of the base surrounding the base's opening, which rim has a tendency to become worn or pitted over time and use. Due to the rim's wear and tear, the gasket may fail to engage evenly against the base. Gaps caused by the uneven compression will allow vapors to escape.

Unlike a rubber gasket, which is easily replaced if it wears out, the base itself can be very costly and time consuming to remediate, given that it is intended to be permanently affixed to the storage tank. In addition, the more time it takes to remediate the hatch, the worse the problem can become, because exposure to the air can quicken the rate of corrosion.

In many cases in which a hatch fails to seal due to a worn rim, the entire hatch base will need to be decoupled from the body of the tank and replaced at great expense and effort. Replacing the base can be hazardous as well, as personnel conducting the repair may be exposed to the harmful vapors released from the storage tank during the remediation process. Often, the entire storage tank must be discarded because of the faulty hatch.

SUMMARY

A replaceable liner is for use with a storage tank hatch having a rim adapted to engage with a gasket within a cover and a neck extending vertically downward from the rim to define an aperture that provides access to an inside of the storage tank. The replaceable liner has a body having a rim-facing surface having a vertical cross sectional shape that conforms to a vertical cross sectional shape of the rim and a horizontal cross sectional shape that conforms to a perimeter of the rim, and a gasket facing surface opposite the rim facing surface. Sealant is provided along the rim facing surface of the body, the rim facing surface of the body adapted to engage the rim in a vapor-tight seal, and the gasket facing surface adapted to engage the gasket in a vapor-tight seal.

Another embodiment of the replaceable liner for use with a hatch can include a ring portion generally conforming to the annular rim and adapted to engage with the annular rim such that a vapor-tight seal is formed between the replaceable liner and the hatch, and further adapted to engage and form a vapor-tight seal with the cover. The replaceable liner can also include an internal extension extending vertically downward from the ring portion into the aperture and generally conforming to the internal perimeter of the hatch.

When the cover is closed on the hatch on which the replaceable liner is disposed, a vapor-tight seal between the replaceable liner and the cover can be formed when a gasket associated with the cover that exerts force against the ring portion of the replaceable liner. A sealant such as a synthetic lubricant, petroleum based sealant, natural sealant or a silicon-based adhesive can be used between the hatch and the replaceable liner to ensure a vapor-tight seal between the hatch and the replaceable liner. Accordingly, a vapor-tight seal will be formed throughout the hatch assembly and vapors will be prevented from escaping the fluid storage tank.

The replaceable liner can be adapted to hatches having a variety of geometries. For example, the ring portion can include a contoured region conforming to a contour of the annular rim. Additionally, if the hatch includes a generally horizontal plate, the replaceable liner can include a flange portion projecting radially outward from the ring portion, where the flange portion generally conforms to the generally horizontal plate. On the other hand, if the hatch includes a vertical external perimeter extending vertically downward from the annular rim, the replaceable liner can include an external extension extending vertically downward from the ring portion, generally conforming to the vertical external perimeter.

The replaceable liner can be manufactured from stamped metal, such as aluminum, stainless steel, or other types of stamped metal appropriate for the particular fluid being held in the fluid storage tank.

BRIEF DESCRIPTION OF THE DRAWINGS

The description herein makes reference to the accompanying drawings wherein like reference numerals refer to like parts throughout the several views, and wherein.

DETAILED DESCRIPTION

Disclosed herein is a replaceable liner for use with fluid storage tank hatches. Several types of example prior art hatches are described, as the claimed invention may be adapted for a variety of hatch geometries. Correspondingly, several embodiments of the claimed invention are disclosed. It is to be understood that the instant disclosure is not intended to be limited to these embodiments; on the contrary, the disclosure is intended to cover various modifications and arrangements, depending on the particular geometry of the hatch used, without departing from the spirit and scope of the appended claims.

Figure 1:
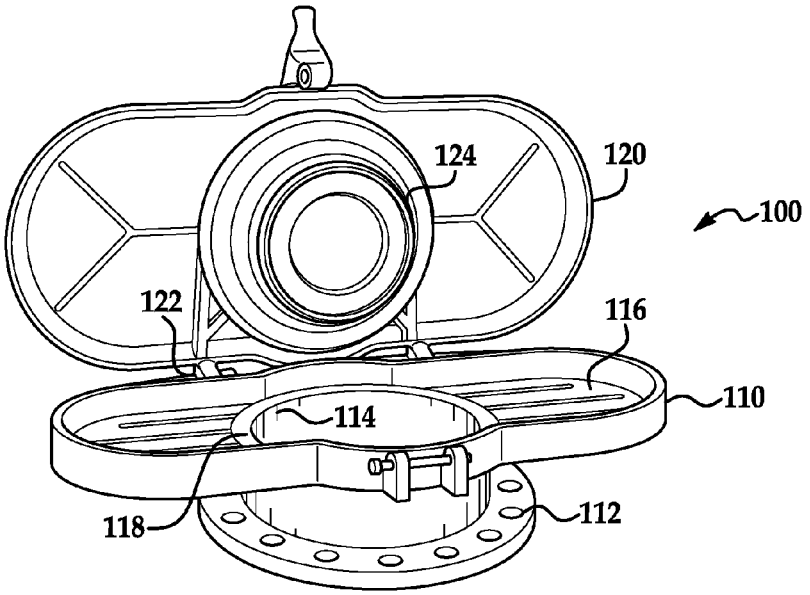
FIG. 1 PRIOR ART
FIG. 1 is a line drawing of an example prior art hatch assembly.

FIG. 1 is a line drawing of an example prior art hatch assembly 100 for which the disclosed embodiments may be used. As depicted in FIG. 1, the hatch assembly 100 includes a hatch 110 and cover 120. The hatch 110 can be bolted or otherwise coupled to a fluid storage tank (not shown). Holes 112 in the hatch 110 may be provided for this purpose. The hatch 110 has a generally vertical internal perimeter or neck 114 defining an aperture that provides access to the fluid stored in the fluid storage tank. The hatch 110 in this example includes a surface 116 that is generally horizontal. A rim 118 defines the intersection of the internal perimeter 114 and the plate 116. Where the surface or plate 116 is absolutely horizontal and the internal perimeter 114 is absolutely vertical, this intersection may be a right angle. However, the rim 118 can also include a ridge or protrusion that rises slightly above the plate 116 (as described in more detail below in discussing the disclosed replaceable liner).

This example hatch assembly 100 also includes a cover 120 designed to close on the hatch 110 in a vapor-tight manner. The cover 120 and hatch 110 may be connected by means of a hinge 122. The cover 120 includes a gasket 124 (usually made of rubber or a rubber-like material) corresponding to the rim 118. Closing the hatch assembly 100 causes the gasket 124 to exert force on and compress against the rim 118, and such compression results in a seal between the hatch 110 and the cover 120.

Figure 2:
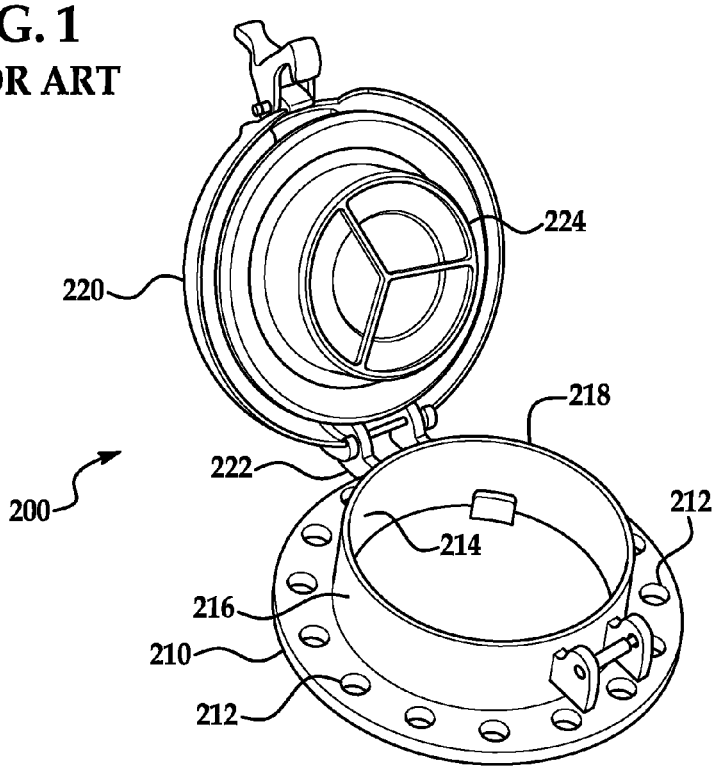
FIG. 2 PRIOR ART
FIG. 2 is a line drawing of another example prior art hatch assembly.

FIG. 2 is a line drawing of another type of example prior art hatch assembly 200 that can also be used with the disclosed embodiments. As depicted in FIG. 2, the hatch assembly 200 includes a hatch 210 and a cover 220. The hatch 210 can be bolted or otherwise coupled to a fluid storage tank (for which holes 212 may be provided). The hatch 210 has a neck or a generally vertical internal perimeter 214 defining an aperture providing access to the fluid stored in the fluid storage tank. The hatch 210 in this example has an external perimeter 216 opposite the internal perimeter 214, together forming a kind of neck. An annular rim 218 at the distal end of both the internal perimeter 214 and the external perimeter 216 defines the intersection between the two.

This example hatch assembly 200 also includes a cover 220 designed to close on the hatch 210 in a vapor-tight manner. The cover 220 and hatch 210 may be connected by means of a hinge 222. The cover 220 includes a (rubber or equivalent) gasket 224 corresponding to the rim 218. Closing the hatch assembly 200 causes the gasket 224 to exert force on and compress against the rim 218, and such compression results in a seal between the hatch 210 and the cover 220.

Figure 3A:
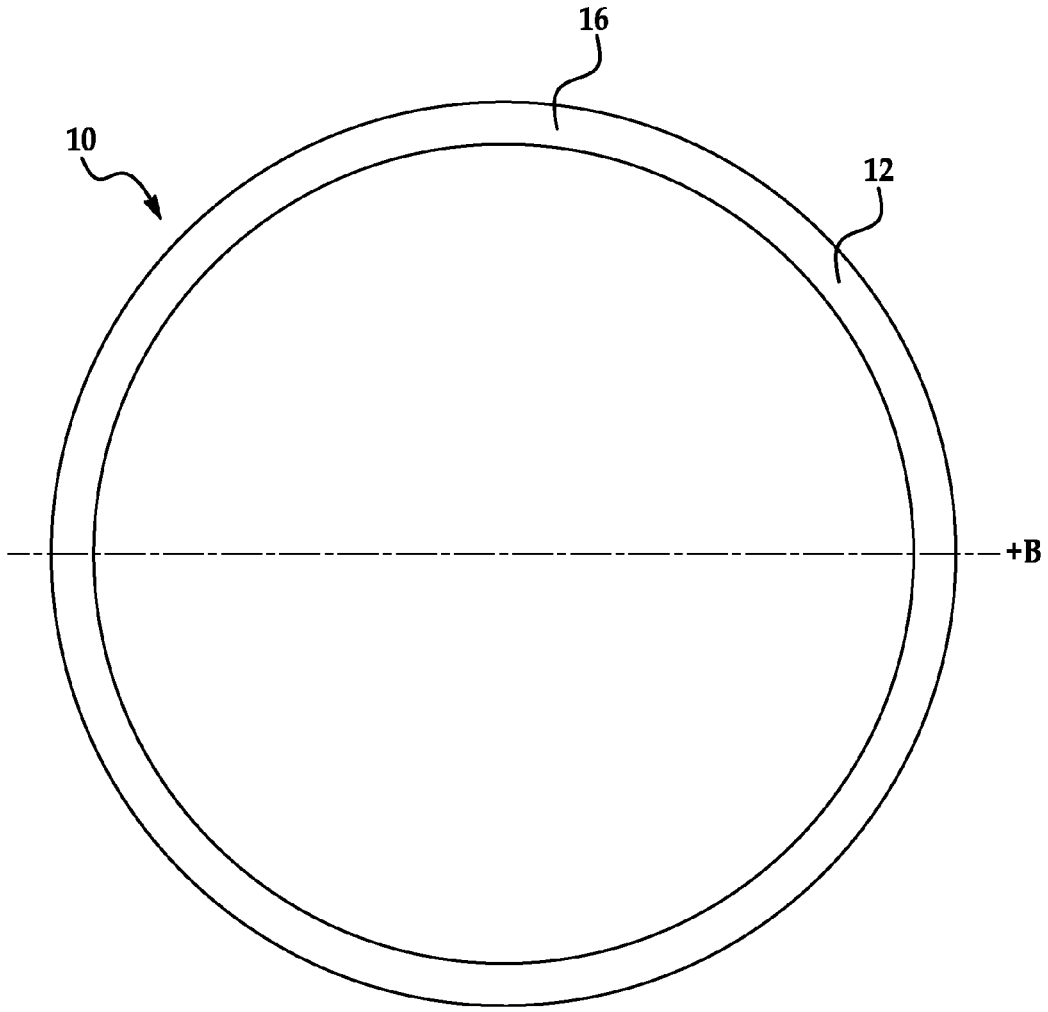
FIG. 3A is a plan view of a replaceable liner as disclosed herein.
Figure 3B:
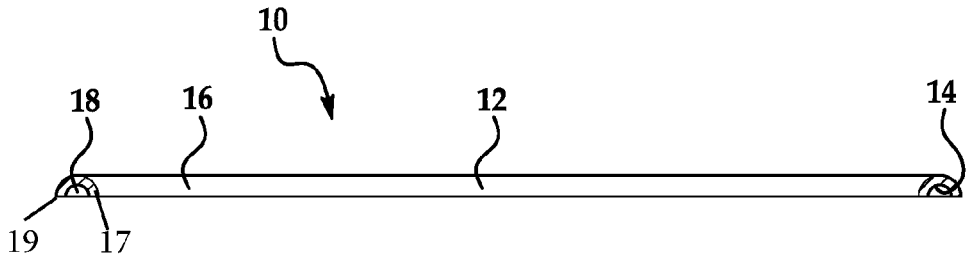
FIG. 3B is a cross sectional view of FIG. 3A along line B.

A replaceable liner 10 is shown in FIGS. 3A and 3B. FIG. 3A is a plan view of the replaceable liner 10 and illustrates a horizontal cross sectional shape of the liner 10. FIG. 3B is a vertical cross section of the replaceable liner 10. The replaceable liner is used with a storage tank hatch 200 having a rim 218 adapted to engage with a gasket 224 within a cover 220 and a neck 216 extending vertically downward from the rim 218 to define an aperture that provides access to an inside of the storage tank. The replaceable liner 10 has a body 12 having a rim-facing surface 14 having a vertical cross sectional shape that conforms to a vertical cross sectional shape of the rim 218 and a horizontal cross sectional shape that conforms to a perimeter of the rim 218. The body 12 also has a gasket facing surface 16 opposite the rim facing surface 14. Sealant is provided along the rim facing surface 14 of the body 12, the rim facing surface 14 of the body 12 adapted to engage the rim 218 in a vapor-tight seal, and the gasket facing surface 16 adapted to engage the gasket 224 in a vapor-tight seal.

The replaceable liner 10 can be used with any type of hatch, including but not limited to those shown in FIGS. 1 and 2. The horizontal cross sectional shape, or plan view shape, of the replaceable liner 10 is shown as circular. However, the liner 10 will be whatever shape the rim 118, 218 is, which can also include oval or any other shape known to those skilled in the art used in the tank hatch art.

The vertical cross sectional shape of the liner 10 is illustrated as an arc, which conforms to cross sectional shape of the rim 118, 218 illustrated in FIGS. 1 and 2. However, this is not meant to be limiting. The cross sectional shape of the liner 10 can conform to any shape known to those skilled in the art used for the rim of a hatch, such as square, lipped, etc. "Conform to" as used herein indicates that the rim 118, 218 generally matingly fits in a recess 18 in the body 12 of the replaceable liner 10 defined by the rim facing surface 14. The sides 20, 22 of the body 12 only need to extend in use on each side of the rim 118, 218 so that the vapor-tight seal is not obstructed.

Figure 4:
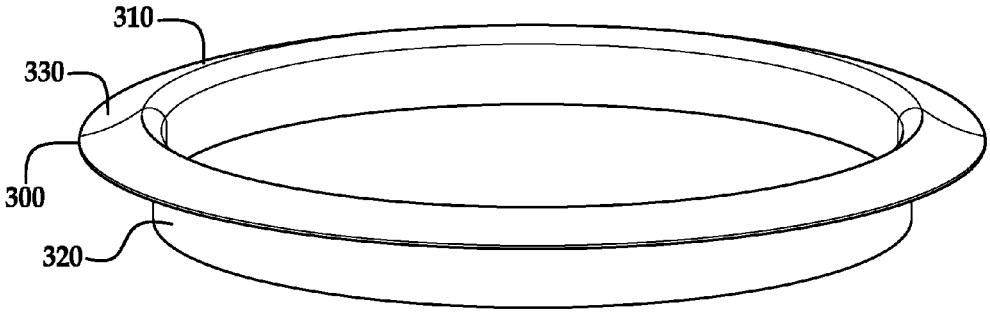
FIG. 4 is a perspective view of another embodiment of a replaceable liner useable with the prior art hatch assembly of FIG. 1.
Figure 5:
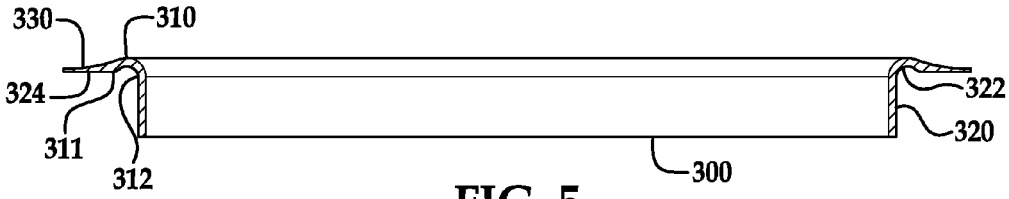
FIG. 5 is a cross-sectional view of the replaceable liner of FIG. 4.

FIGS. 4 and 5 reflect a perspective view and a cross-section view, respectively, of another embodiment of a replaceable liner 300. In particular, this embodiment is adapted for use with the example prior art hatch assembly 100 shown in FIG. 1 (which includes a horizontal plate 116).

The replaceable liner 300 can include a body or ring portion 310 adapted to be positioned on the rim 118 of the hatch 110. To enhance the fit, the underside of the ring portion 310 can include a contoured region 112 to conform to the specific geometry of the rim 118 (for example, in cases where the rim 118 is not merely a right-angle intersection between the hatch's 110 internal perimeter 114 and plate 116, but rather protrudes above the plate 116). The replaceable liner 300 can optionally include an internal extension 320 projecting downward from the ring portion 310 and generally conforming to the internal perimeter 114 of the hatch 110. When the replaceable liner 300 is disposed on the hatch 110, it can fit securely against the rim 118 and the internal perimeter 114. The replaceable liner 300 can also include a flange 330 projecting out from at least a portion of a perimeter 311 of the body 310 or ring portion 310, adapted to rest on the plate or generally horizontal surface 116 of the hatch 110. If the plate 116 has a contour (that is, it is not absolutely horizontal), the flange 330 can be contoured to conform to the plate's 116 contour, to ensure a proper fit. For example, the flange 330 may be angled or have ridges. The flange 330 can extend from more than one portion of the perimeter 311 of the body 312 or can extend from the entire perimeter 311 depending on the desired or required sealing needs.

The sealant can be applied on the rim facing surface 322 of the replaceable liner 300 to displace any air or space present between the replaceable liner 300 and the rim 118, and to produce a suction effect when pressure is applied. This will enhance a vapor-tight seal between the hatch 110 and the replaceable liner 300. Example sealants that may be employed include synthetic lubricants, silicone-based adhesives, Permatex® brand adhesive, greases, petroleum based sealants, natural sealants and other sealants or adhesives. The sealant can also be applied to a surface 324 of the flange 330 configured to face the generally horizontal surface 116 of the hatch 110.

With the replaceable liner 300 disposed on the hatch 110 as described, closing the hatch assembly 100 causes the gasket 124 to exert force on and compress against the ring portion 310 of the replaceable liner 300. A vapor-tight seal is thus formed between the cover 120 and the replaceable liner 300. The compression can also cause the replaceable liner 300 to exert force against the hatch 110, reinforcing the seal between the hatch 110 and the replaceable liner 300 as well. Accordingly, a vapor-tight seal will be established throughout the hatch assembly 100.

Figure 6:
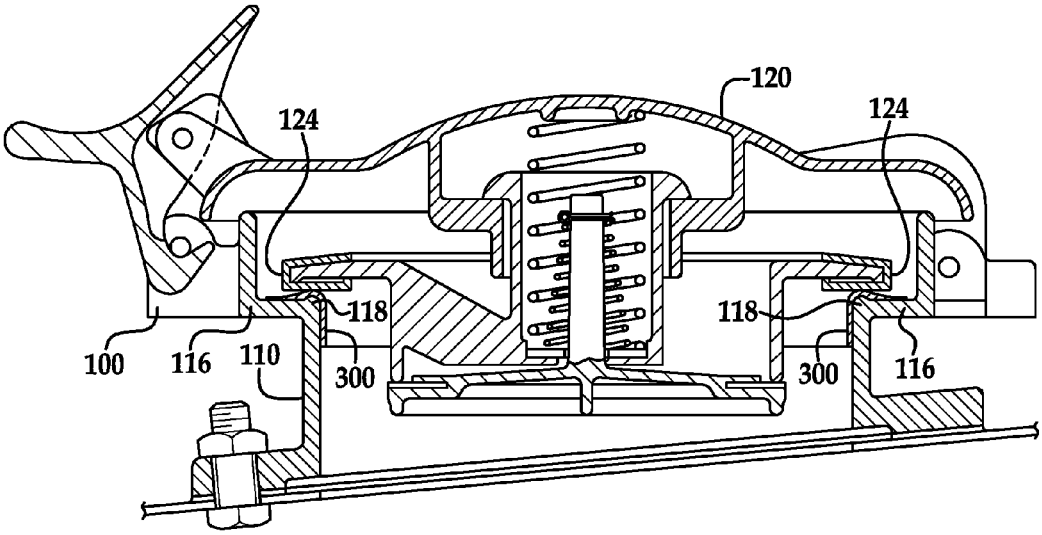
FIG. 6 is a cross-sectional view of the replaceable liner or FIG. 4 engaged on the prior art hatch assembly of FIG. 1.

FIG. 6 is a cross-sectional view of the replaceable liner 300 engaged on the prior art hatch assembly 100 (in the closed position). As illustrated, the replaceable liner 300 is disposed on, and conforms to, the geometry of the various elements of the hatch 110, including the rim 118, the internal perimeter 114, and the plate 116. When the cover 120 is closed on the hatch 110, the gasket 124 exerts force on and compresses against the replaceable liner 300 (rather than the rim 118 directly). Thus, the hatch assembly 100 is rendered fluid tight, preventing any vapors from escaping the fluid storage tank.

The replaceable liner 300 can be manufactured from stamped aluminum or stainless steel, or from any other metal or material known in the art. Combinations of metals can also be used. The particular material used can be chosen based on the type of fluid contained in the fluid storage tank and the type of metal that will be unreactive to such fluid. For example, some contaminants may react with—and corrode—aluminum but not copper. In this instance, a copper replaceable liner 300 can be used.

The replaceable liner 300 can be used as a remedial measure for a hatch assembly 100 with a worn down or pitted rim 118. Adding the replaceable liner 300 (including in combination with a sealant, as described above) can restore the seal in the hatch assembly 100 and render it useable again. The replaceable liner 300 can also be used prophylactically with a new hatch assembly 100 to shield the rim 118 from wear in the first instance.

In addition, the replaceable liner 300 can be manufactured to be stronger and less susceptible to wear than the stock hatch 110 (based on the type of metal used or the thickness of the material), or alternatively, it can be manufactured to be inexpensive and disposable, so that when it wears out, it can easily and cheaply be replaced. In any case, there are many advantages it can provide for users of storage tank hatches. Moreover, other variations of the disclosed exemplary embodiments can be employed advantageously without departing from the spirit and scope of the appended claims.

Figure 7:
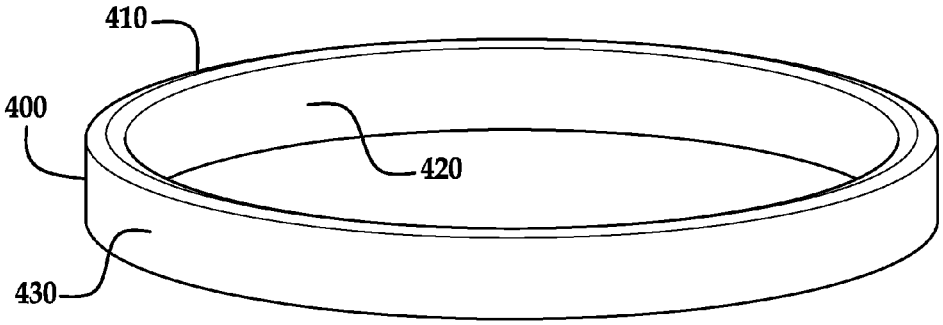
FIG. 7 is a perspective view of a replaceable liner useable with the prior art hatch assembly of FIG. 2.
Figure 8:
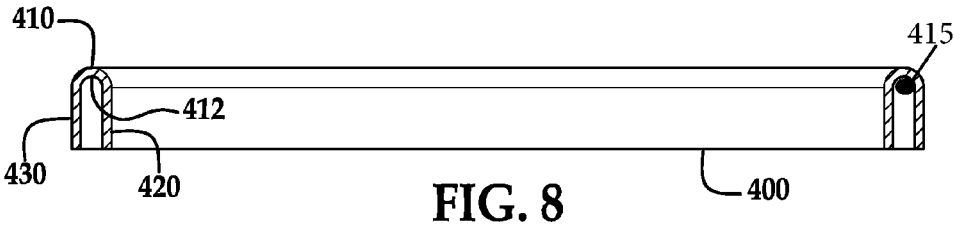
FIG. 8 is a cross-sectional view of the replaceable liner of FIG. 7.

FIGS. 7 and 8 reflect a perspective view and a cross-section view, respectively, of another embodiment of a replaceable liner 400. In particular, this embodiment is adapted for use with the example prior art hatch assembly 200 shown in FIG. 2 (including a neck formed by the internal perimeter 214 and external perimeter 216 of the hatch 210).

The replaceable liner 400 can include a ring portion 410 adapted to be positioned on the rim 218 of the hatch 210. To enhance the fit, the underside of the ring portion 410 can include a contoured region 412 to conform to the specific geometry of the rim 218. The replaceable liner 400 can also include an internal extension 420 projecting downward from the ring portion 410 and generally conforming to the internal perimeter 214 of the hatch 210. An external extension 430 can project downward from the opposite side of the ring portion 410 and conform to the external perimeter 216 of the hatch 210. Thus, the replaceable liner 400 can fit securely on the rim 218 when disposed on the hatch 210.

As discussed above in the previous embodiment, a sealant can be applied between the replaceable liner 400 and the hatch 210 to reinforce the vapor-tight seal by displacing any air or space and by producing a suction when pressure is applied.

When the hatch assembly 200 is closed, the gasket 224 on the cover 220 will exert force on and compress against the ring portion 410 of the replaceable liner 400 (rather than the rim 218 of the hatch 210 directly). Accordingly, a vapor-tight seal is formed between the cover 220 and the replaceable liner 400, thereby resulting in a vapor-tight seal throughout the hatch assembly 200.

Figure 9:
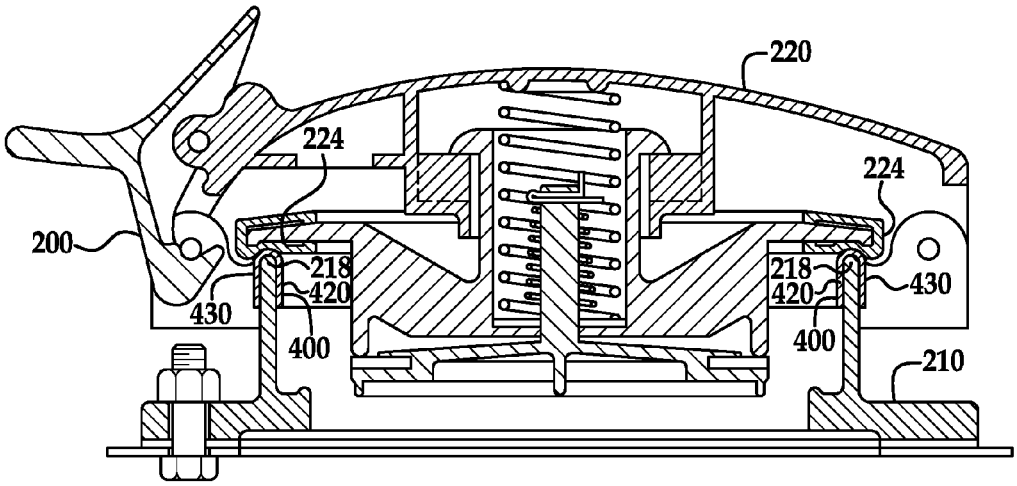
FIG. 9 is a cross-sectional view of the replaceable liner or FIG. 7 engaged on the prior art hatch assembly of FIG. 2.

FIG. 9 is a cross-sectional view of the replaceable liner 400 engaged on the prior art hatch assembly 200 (in the closed position). As illustrated, the replaceable liner 400 is disposed on, and conforms to, the geometry of the various elements of the hatch 210, including the rim 218, the internal perimeter 214, and the external perimeter 216. When the cover 220 is closed on the hatch 210, the gasket 224 exerts force on and compresses against the replaceable liner 400 (rather than the rim 218 directly). Thus, the hatch assembly 200 is rendered fluid tight, preventing any vapors from escaping the fluid storage tank.

The foregoing description relates to what are presently considered to be the most practical embodiments, but it is to be understood that the disclosure is intended to cover various modifications and equivalent arrangements. The scope of the claims is thus to be accorded the broadest interpretation so as to encompass all such modifications and equivalent structures as is permitted under the law.

What is claimed is:

1. A replaceable liner for a hatch of a storage tank, the hatch having a rim adapted to engage with a gasket within a cover and a neck extending vertically downward from the rim to define an aperture that provides access to an inside of the storage tank, the replaceable liner comprising:

a body having a vertical cross sectional shape that is an arch with a rounded top, an inner wall and an outer wall, the outer wall being shorter or equal in length than the inner wall, and a horizontal cross sectional shape that is a continuous ring and conforms to a perimeter of the rim, a rim-facing surface on an interior of the body and a gasket facing surface opposite the rim facing surface; and sealant provided along the rim-facing surface of the body in the arch, the rim-facing surface of the body adapted to engage the rim in a vapor-tight seal, and the gasket facing surface adapted to engage the gasket in a vapor-tight seal; and the outer wall has a distal edge, the replaceable liner further comprising a flange projecting radially outward from the distal edge along at least a portion of a perimeter of the outer wall in a horizontal plane substantially parallel to the ground.

2. The replaceable liner of claim 1, wherein the sealant is further provided along a surface of the flange configured to face the generally horizontal surface of the hatch.

3. The replaceable liner of claim 1, wherein the sealant is a synthetic lubricant.

4. The replaceable liner of claim 1, wherein the sealant is a silicon-based adhesive.

5. The replaceable liner of claim 1, made of stamped metal.

6. The replaceable liner of claim 1, made of one or a combination of two or more of aluminum, stainless steel, and copper.

7. The replaceable liner of claim 1, wherein the replaceable liner is removable and disposable.

8. A replaceable liner for a hatch of a storage tank, the hatch having a rim adapted to engage with a gasket within a cover and a neck extending vertically downward from the rim to define an aperture that provides access to an inside of the storage tank, the replaceable liner comprising:

a body having a vertical cross sectional shape that is an arch with a rounded top, an outer wall and an inner wall, the outer wall being shorter in length than the inner wall, and a horizontal cross sectional shape that is a continuous ring and conforms to a perimeter of the rim, the body having a rim-facing surface and a gasket facing surface opposite the rim facing surface, the rim-facing surface of the body adapted to engage the rim in a vapor-tight seal, and the gasket facing surface adapted to engage the gasket in a vapor-tight seal; and a flange portion projecting radially outward from a distal edge of the outer wall of the body, wherein the flange portion forms an approximately 90° angle with the inner wall of the body to project outward from body.

9. The replaceable liner of claim 8, made of stamped metal.

10. The replaceable liner of claim 8, made of one or a combination of two or more of aluminum, stainless steel, and copper.

11. The replaceable liner of claim 8, wherein the replaceable liner is removable and disposable.

* * * * *